US011981526B2

(12) United States Patent
Yoshida

(10) Patent No.: US 11,981,526 B2
(45) Date of Patent: May 14, 2024

(54) SHEET CONVEYING DEVICE, IMAGE FORMING APPARATUS

(71) Applicant: KYOCERA Document Solutions Inc., Osaka (JP)

(72) Inventor: Takeshi Yoshida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 118 days.

(21) Appl. No.: 17/869,566

(22) Filed: Jul. 20, 2022

(65) Prior Publication Data

US 2023/0026333 A1 Jan. 26, 2023

(30) Foreign Application Priority Data

Jul. 21, 2021 (JP) ..... 2021-120287

(51) Int. Cl.
*B65H 3/06* (2006.01)

(52) U.S. Cl.
CPC ..... *B65H 3/0684* (2013.01); *B65H 2402/31* (2013.01)

(58) Field of Classification Search
CPC .... B65H 3/06; B65H 3/0684; B65H 2402/31; B65H 2402/60; B65H 2601/324; G03G 15/6529; G03G 15/6511
See application file for complete search history.

(56) References Cited

U.S. PATENT DOCUMENTS 8,079,586 B2 * 12/2011 Watanabe ..... B65H 3/0638 271/145
8,196,918 B2 * 6/2012 Arimura ..... B65H 3/06 271/167
9,800,748 B2 * 10/2017 Horikawa ..... B65H 3/0669
9,880,505 B2 * 1/2018 Matsumoto ..... B65H 29/22
9,957,123 B2 * 5/2018 Uohashi ..... B65H 1/12
10,486,922 B2 * 11/2019 Horita ..... B65H 3/0684
10,656,587 B2 * 5/2020 Koga ..... B65H 3/0669

FOREIGN PATENT DOCUMENTS

JP 2019059559 A 4/2019

* cited by examiner

*Primary Examiner* — Leslie A Nicholson, III
(74) *Attorney, Agent, or Firm* — Alleman Hall & Tuttle LLP

(57) ABSTRACT

A rotating body unit includes a rotating body and a frame body. The frame body includes a pair of bearing portions. A mounting portion includes a pair of opposing walls facing each other in a width direction, a mounting space formed between the opposing walls, a pair of bearing support members, and a pair of biasing members. The bearing support members are supported by the opposing walls to be movable in the width direction. The biasing members bias the bearing support members inward in the width direction. When the rotating body unit is inserted into the mounting space, the bearing portions abut on a pair of guide surfaces of the bearing support members and move the bearing support members from support positions to retraction positions, and the bearing support members move from the retraction positions to the support positions to support the bearing portions.

4 Claims, 6 Drawing Sheets

SHEET CONVEYING DEVICE, IMAGE FORMING APPARATUS

INCORPORATION BY REFERENCE

This application is based upon and claims the benefit of priority from the corresponding Japanese Patent Application No. 2021-120287 filed on Jul. 21, 2021, the entire contents of which are incorporated herein by reference.

BACKGROUND

The present disclosure relates to a sheet conveying device provided with a rotating body unit including a rotating body that conveys sheets to a conveyance path and relates to an image forming apparatus.

An image forming apparatus is provided with a sheet conveying device and a printing device. The sheet conveying device conveys sheets placed on a sheet placement portion to a conveyance path inside the main body and then conveys the sheets along the conveyance path. The printing device forms images on the sheets conveyed along the conveyance path.

The sheet conveying device is provided with a pickup roller and a feed roller that rotate while in contact with the sheets. The pickup roller and the feed roller convey the sheets placed on the sheet placement portion to the conveyance path.

The pickup roller and the feed roller are consumables that degrade due to adhesion of paper dust or wear. Accordingly, it is desirable that the pickup roller and the feed roller can be removed from and installed in the main body by users.

For example, the pickup roller and the feed roller may be provided as a rotating body unit that is removably mounted in the main body.

The rotating body unit is provided with the pickup roller, the feed roller, and a frame body. The pickup roller and the feed roller are rotatably supported by the frame body.

SUMMARY

A sheet conveying device according to an aspect of the present disclosure includes a housing and a sheet feed portion configured to feed a sheet placed on a sheet placement portion to a conveyance path. The sheet feed portion includes a mounting portion disposed in the housing and a rotating body unit mountable in the mounting portion. The rotating body unit includes a rotating body with a rotation shaft and a frame body supporting the rotating body. The rotating body unit is mountable in the mounting portion in a mounting direction intersecting a width direction along the rotation shaft. The frame body includes a pair of sidewalls and a pair of bearing portions. The pair of sidewalls face each other in the width direction. The pair of bearing portions protrude outward from the pair of sidewalls in the width direction and support both ends of the rotation shaft such that the rotation shaft can rotate. The mounting portion includes a pair of opposing walls, a mounting space, a pair of bearing support members, and a pair of biasing members. The pair of opposing walls face each other in the width direction. The mounting space is formed between the pair of opposing walls. The pair of bearing support members are supported by the pair of opposing walls to be movable in the width direction. The pair of biasing members bias the pair of bearing support members inward in the width direction. When located at support positions inside the pair of opposing walls, the pair of bearing support members can support the pair of bearing portions, and when located at retraction positions outside the support positions along the width direction, the pair of bearing support members face each other with a space into which the pair of bearing portions can be inserted therebetween. The pair of bearing support members include a pair of guide surfaces inclined inward along the width direction and facing the rotating body unit when the rotating body unit is mounted in the mounting portion in the mounting direction. When the rotating body unit is inserted into the mounting space in the mounting direction, the pair of bearing portions abut on the pair of guide surfaces of the pair of bearing support members and move the pair of bearing support members from the support positions to the retraction positions, and then the pair of bearing support members move from the retraction positions to the support positions by a biasing force of the pair of biasing members to support the pair of bearing portions.

An image forming apparatus according to another aspect of the present disclosure is provided with the sheet conveying device and a printing device. The printing device forms an image on a sheet conveyed by the sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

Figure 1:
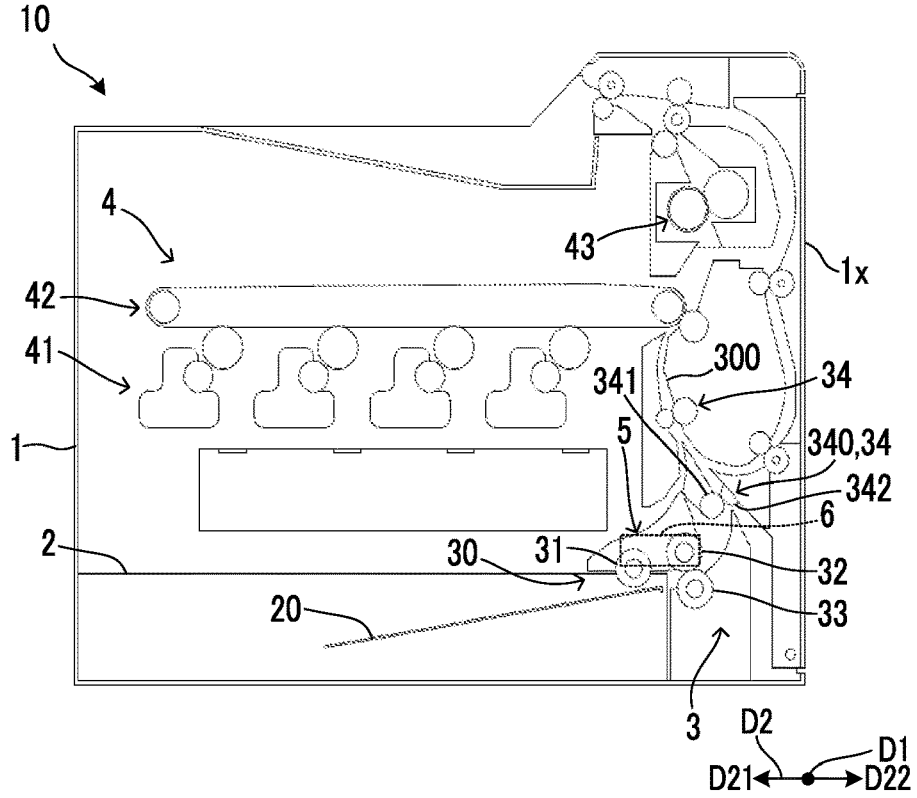
FIG. 1 is a configuration diagram of an image forming apparatus provided with a sheet conveying device according to an embodiment.

As shown in FIG. 1, a sheet conveying device 3 according to an embodiment constitutes a part of an image forming apparatus 10.

The image forming apparatus 10 is provided with a sheet storing portion 2, the sheet conveying device 3, and a printing device 4. The sheet conveying device 3 and the printing device 4 are housed inside a main body 1. The main body 1 is a housing that houses the sheet conveying device 3 and the printing device 4.

The sheet storing portion 2 is provided with a sheet placement portion 20 on which multiple sheets can be placed. The sheet conveying device 3 conveys the sheets placed on the sheet placement portion 20 to a conveyance path 300 inside the main body 1. Furthermore, the sheet conveying device 3 conveys the sheets along the conveyance path 300.

The sheet conveying device 3 is provided with a sheet feed portion 30 and multiple pairs of conveying rollers 34 disposed inside the main body 1. The sheet feed portion 30 feeds the sheets placed on the sheet placement portion 20 to the conveyance path 300.

The sheet feed portion 30 includes a pickup roller 31, a feed roller 32, and a separation roller 33. The multiple pairs of conveying rollers 34 include a pair of lead-in rollers 340.

The pickup roller 31 rotates while in contact with the top surface of the topmost sheet placed on the sheet placement portion 20. This causes the pickup roller 31 to send the sheet from the sheet placement portion 20 to the feed roller 32.

The feed roller 32 is in contact with the separation roller 33. The feed roller 32 comes into contact with the top surface of the sheet sent by the pickup roller 31 while rotating. This causes the feed roller 32 to send the sheet to the conveyance path 300.

In a case where multiple sheets are sent by the pickup roller 31, the separation roller 33 stops one or more sheets, in the multiple sheets, that are not in contact with the feed roller 32. Thus, the pickup roller 31, the feed roller 32, and the separation roller 33 feed the sheets placed on the sheet placement portion 20 one by one to the conveyance path 300.

It is noted that the pickup roller 31 and the feed roller 32 are examples of a rotating body that coveys the sheets placed on the sheet placement portion 20 to the conveyance path 300 inside the main body 1.

The multiple pairs of conveying rollers 34 rotate to convey the sheets along the conveyance path 300. The pair of lead-in rollers 340 take over the conveyance of the sheets from the feed roller 32. The pair of lead-in rollers 340 include a first lead-in roller 341 and a second lead-in roller 342 (see FIGS. 1 and 2).

The printing device 4 executes a printing process to form images on the sheets conveyed by the sheet conveying device 3. In the example shown in FIG. 1, the printing device 4 executes the printing process by an electrophotographic method.

To do so, the printing device 4 is provided with image creating devices 41, a transfer device 42, and a fixing device 43. The image creating devices 41 create toner images. The transfer device 42 transfers the toner images to the sheets. The fixing device 43 heats and pressurizes the toner images on the sheets to fix the toner images onto the sheets.

The printing device 4 may execute the printing process by another method such as an inkjet printing method.

The pickup roller 31 and the feed roller 32 are consumables that degrade due to adhesion of paper dust or wear. Accordingly, it is desirable that the pickup roller 31 and the feed roller 32 can be removed from and installed in the main body 1 by users.

The sheet conveying device 3 is provided with the pickup roller 31 and the feed roller 32 as a roller unit 5. The roller unit 5 is removably mounted in the main body 1. The roller unit 5 is an example of a rotating body unit.

The sheet feed portion 30 is provided with a mounting portion 6 and the roller unit 5. The mounting portion 6 is attached to the main body 1. The roller unit 5 is mounted in the mounting portion 6 (see FIGS. 1 to 3).

Figure 4:
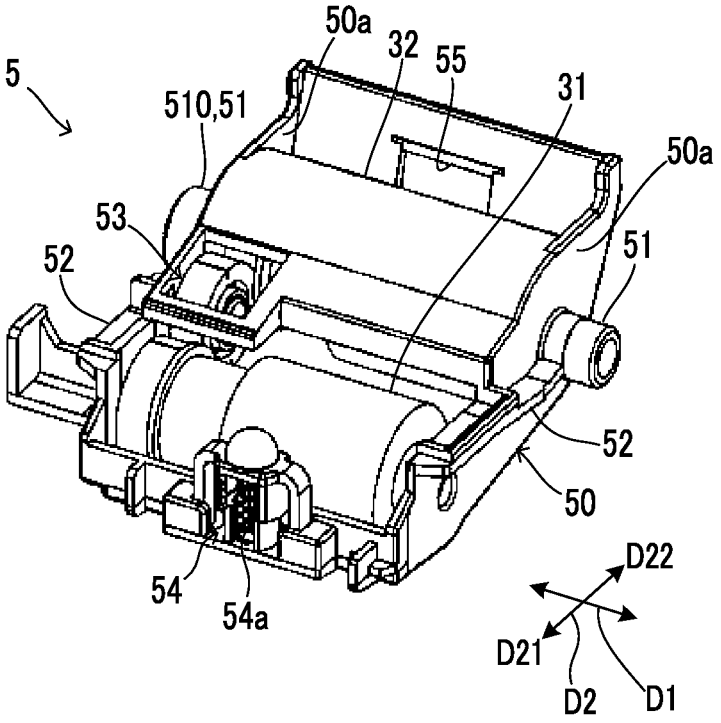
FIG. 4 is a first perspective view of the roller unit in the sheet conveying device according to the embodiment.
Figure 5:
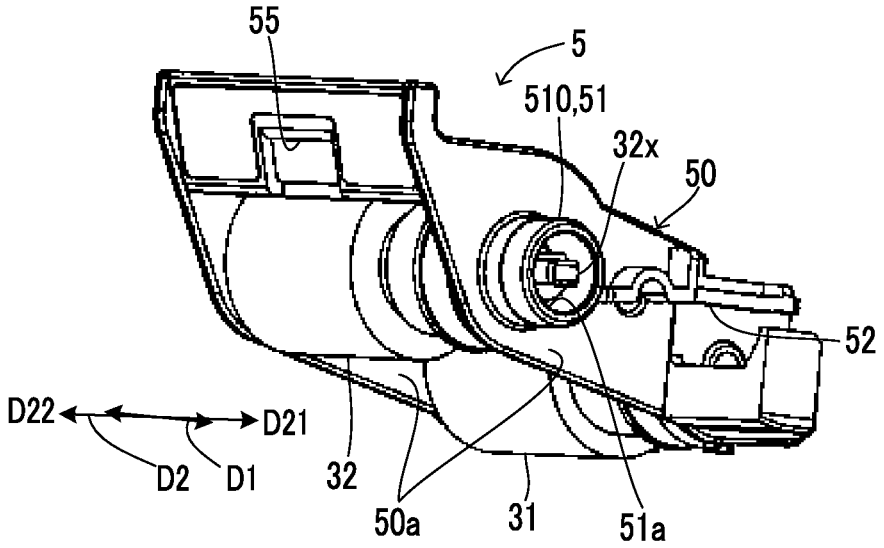
FIG. 5 is a second perspective view of the roller unit in the sheet conveying device according to the embodiment.

As shown in FIGS. 4 and 5, the roller unit 5 is provided with the pickup roller 31, the feed roller 32, and a frame body 50. The pickup roller 31 and the feed roller 32 are rotatably supported by the frame body 50. For example, the frame body 50 is a member formed from synthetic resin.

Figure 2:
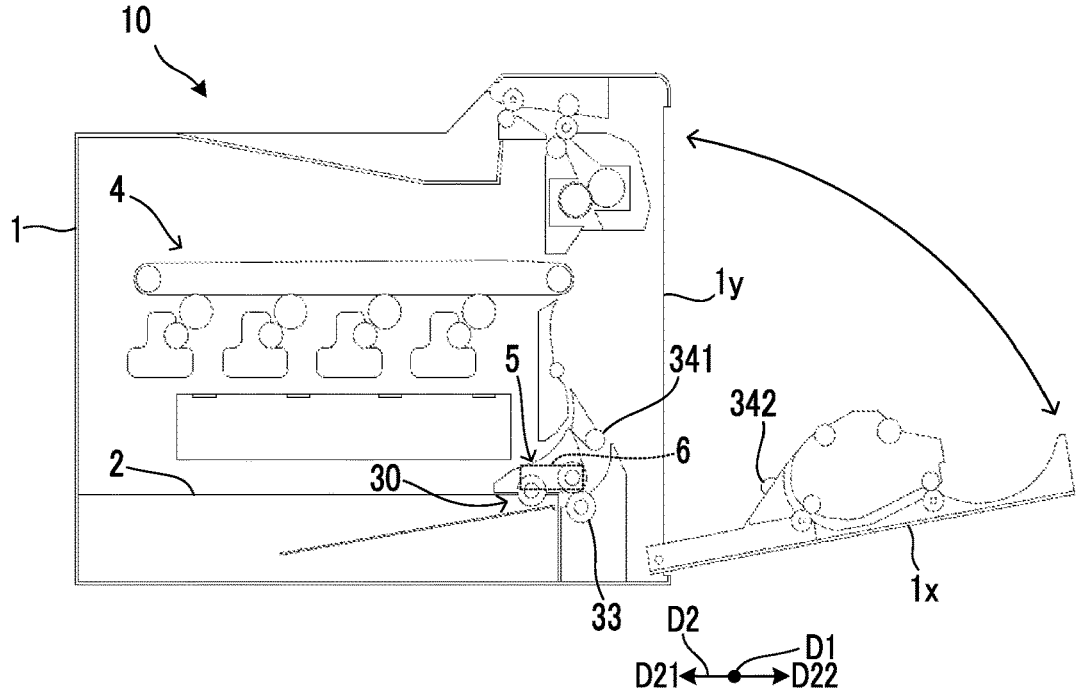
FIG. 2 shows the image forming apparatus with its rear cover open.
Figure 3:
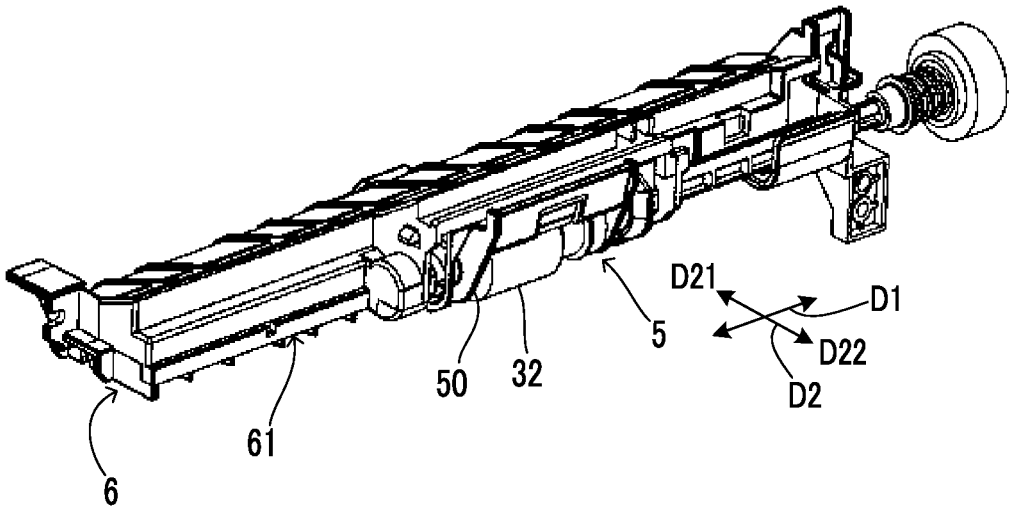
FIG. 3 is a perspective view of a roller unit and a mounting portion in the sheet conveying device according to the embodiment.

The image forming apparatus 10 is further provided with a rear cover 1*x* that can open and close an opening 1*y* created in the rear of the main body 1 (see FIGS. 1 and 2). The roller unit 5 is exposed through the opening 1*y* in the main body 1 when the rear cover 1*x* is open.

The roller unit 5 can be mounted in and removed from the mounting portion 6 while the rear cover 1*x* is open.

As shown in FIG. 2, the first lead-in roller 341 is supported by the main body 1, whereas the second lead-in roller 342 is supported by the rear cover 1*x*. Accordingly, opening the rear cover 1*x* causes the second lead-in roller 342 to be separated from the first lead-in roller 341.

The mounting of the roller unit 5 in the main body 1 may involve moving the roller unit 5 in multiple directions. In this case, users need to understand the procedure of moving the roller unit 5 in multiple directions in advance by, for example, reading user manuals.

The mounting is desirably as simple as possible. For example, the mounting may be an operation of only moving the roller unit 5 in one direction toward the main body 1. In this case, the users can mount the roller unit 5 in the main body 1 with intuitive operation.

In the sheet conveying device 3, the roller unit 5 and the mounting portion 6 have configurations that allow the roller unit 5 to be mounted in the main body 1 with operations as simple as possible. The following describes the configurations thereof.

In the drawings, a width direction D1 is parallel to the rotation shafts of the pickup roller 31 and the feed roller 32. The width direction D1 is also parallel to the rotation shafts of the multiple pairs of conveying rollers 34. In addition, in the drawings, a crossing direction D2 is a predetermined direction that intersects with the width direction D1.

The roller unit 5 is mounted in the mounting portion 6 in the crossing direction D2. Furthermore, the roller unit 5 is removed from the mounting portion 6 in the crossing direction D2.

In the drawings, a mounting direction D21 points to the inside of the main body 1 from outside in the crossing direction D2. In the drawings, a removal direction D22 points to the outside of the main body 1 from inside in the crossing direction D2.

The frame body 50 of the roller unit 5 includes a pair of bearing portions 51. The frame body 50 further includes a pair of flange portions 52. Specifically, the frame body 50 includes a pair of sidewalls 50*a* facing each other in the width direction D1. The pair of bearing portions 51 and the pair of flange portions 52 respectively protrude from the pair of sidewalls 50*a*.

The pair of bearing portions 51 protrude outward from the pair of sidewalls 50*a* in the width direction D1. The pair of bearing portions 51 support both ends of the rotation shaft 32*x* of the feed roller 32 such that the rotation shaft 32*x* can rotate.

A specific bearing portion 510, which is one of the pair of bearing portions 51, has a through-hole 51*a* passing therethrough in the width direction D1 (see FIG. 5). A first end of the rotation shaft 32*x* is fitted in the through-hole 51*a* in the specific bearing portion 510.

The pair of flange portions 52 protrude outward from the pair of sidewalls 50*a* in the width direction D1 and extend in the crossing direction D2 (see FIGS. 4 and 5).

The roller unit 5 is further provided with a rotation transmission mechanism 53 and a biasing mechanism 54 (see FIG. 4).

The rotation transmission mechanism 53 transmits the rotational force of the feed roller 32 to the pickup roller 31. For example, the rotation transmission mechanism 53 is a gear mechanism. The rotation transmission mechanism 53 may be a mechanism that transmits the rotational force using an endless belt.

The biasing mechanism 54 biases the pickup roller 31 toward the top surface of the sheet placed on the sheet placement portion 20. In the present embodiment, the biasing mechanism 54 includes a spring 54*a* disposed between part of the mounting portion 6 and the top surface of the sheet placed on the sheet placement portion 20.

The biasing mechanism 54 biases the frame body 50 downward using the elastic force of the spring 54*a*. Thus, the biasing mechanism 54 biases the pickup roller 31 toward the top surface of the sheet on the sheet placement portion 20.

The mounting portion 6 is provided with a base member 61, a pair of bearing support members 62, and a biasing mechanism 65. The base member 61 is secured inside the main body 1. For example, the base member 61 is formed from synthetic resin.

Figure 6:
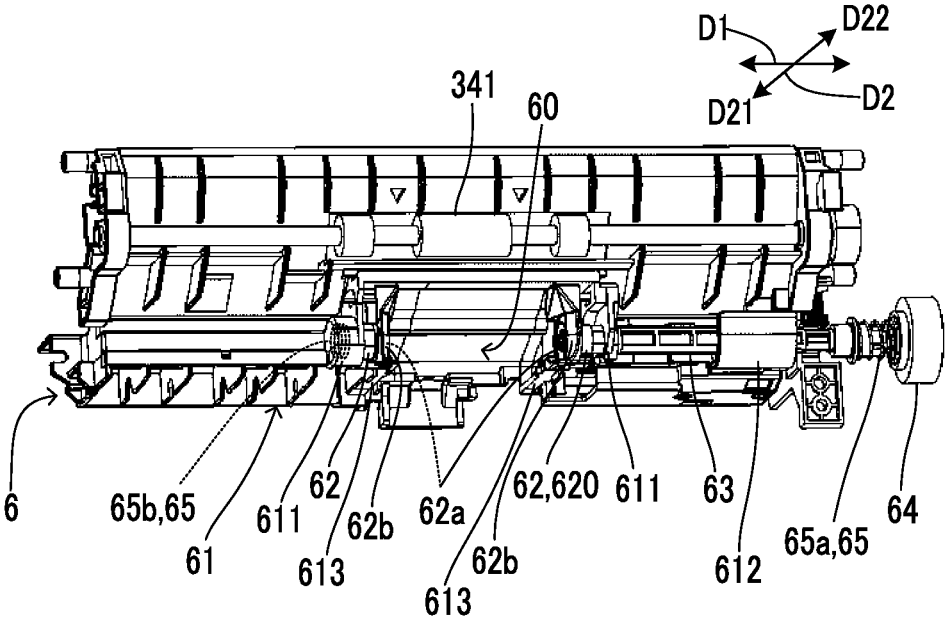
FIG. 6 is a perspective view of the mounting portion and the periphery of the mounting portion in the sheet conveying device according to the embodiment.
Figure 7:
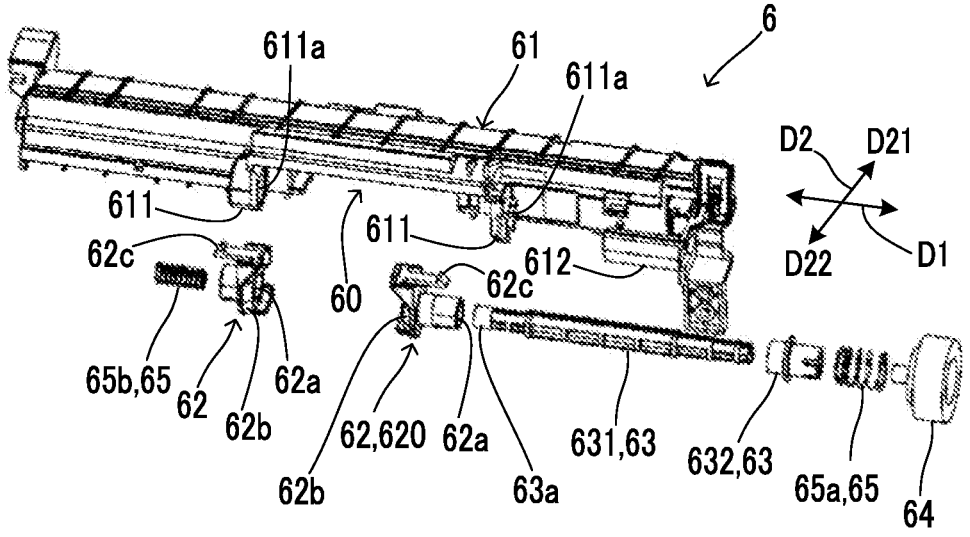
FIG. 7 is an exploded perspective view of the mounting portion in the sheet conveying device according to the embodiment.

The base member 61 includes a pair of opposing walls 611 (see FIGS. 6 and 7). The pair of opposing walls 611 face each other in the width direction D1 with a mounting space 60 therebetween. The mounting space 60 receives the roller unit 5.

The pair of opposing walls 611 support the pair of bearing support members 62 such that the pair of bearing support members 62 can move in the width direction D1. The pair of bearing support members 62 are disposed to face each other in the width direction D1 with the mounting space 60 therebetween. The pair of opposing walls 611 each have an attachment hole 611*a*. The pair of bearing support members 62 are fitted in the attachment holes 611*a* in the pair of opposing walls 611.

Figure 8:
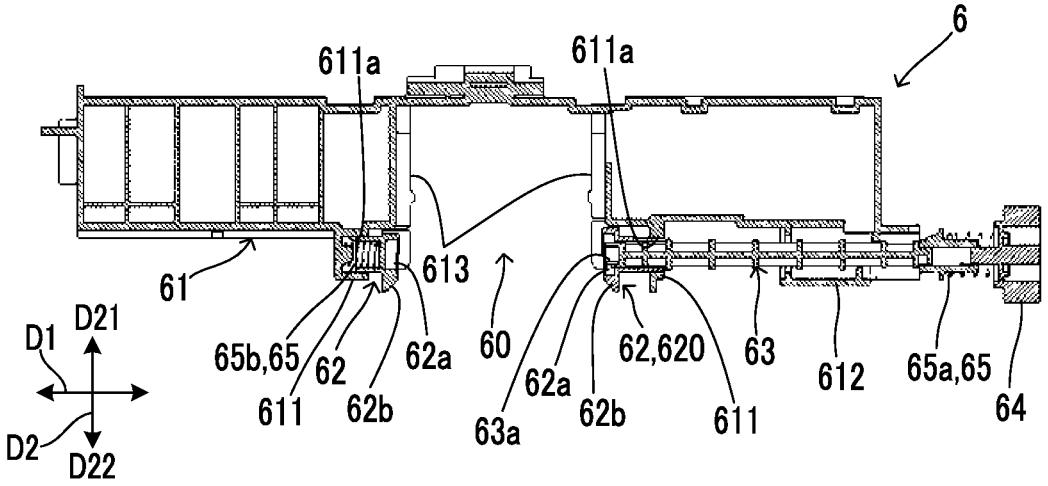
FIG. 8 shows a horizontal cross section of the mounting portion in the sheet conveying device according to the embodiment.
Figure 9:
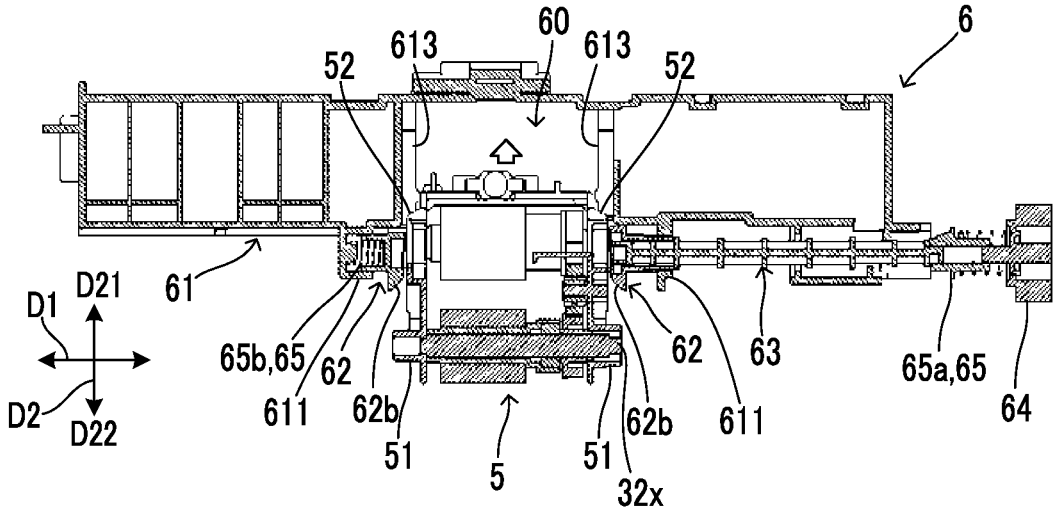
FIG. 9 shows a horizontal cross section of the roller unit and the mounting portion in the sheet conveying device according to the embodiment (when the mounting of the roller unit has started).

The pair of bearing support members 62 are supported to be movable outward from respective predetermined support positions in the width direction D1. FIGS. 8 and 9 show a state where the pair of bearing support members 62 are located at the support positions.

The pair of bearing support members 62 face each other in the width direction D1 with the mounting space 60 therebetween. The pair of bearing support members 62 are supported by the pair of opposing walls 611 to be movable between the support positions and retraction positions. The support positions are located inside the pair of opposing walls 611 along the width direction D1. When located at the support positions, the pair of bearing support members 62 can support the pair of bearing portions 51.

When located at the retraction positions, the pair of bearing support members 62 face each other with a space into which the pair of bearing portions 51 can be inserted therebetween. In other words, when located at the retraction positions, the pair of bearing support members 62 can release the pair of bearing portions 51.

The bearing support members 62 each include a locking portion 62*c* (see FIG. 7). The locking portions 62*c* are caught in part of the base member 61 to restrict the bearing support members 62 from moving inward in the width direction D1 beyond the support positions.

The bearing support members 62 each have a hole 62*a* and a guide surface 62*b* (see FIGS. 6 to 8). That is, the pair of bearing support members 62 have the pair of holes 62*a* and the pair of guide surfaces 62*b*. The bearing portions 51 of the roller unit 5 are inserted into the holes 62*a* in the respective bearing support members 62. Thus, the pair of bearing support members 62 support the pair of bearing portions 51.

The roller unit 5 is supported by the pair of bearing support members 62 to be swingable vertically.

One of the pair of bearing support members 62 is a specific support member 620 that supports the specific bearing portion 510 (see FIGS. 6 to 8). The hole 62*a* in the specific support member 620 is a through-hole that passes through the specific support member 620 in the width direction D1.

The pair of guide surfaces 62*b* adjoin the pair of holes 62*a* in the crossing direction D2 (see FIGS. 6 to 8). Specifically, the pair of guide surfaces 62*b* are located on sides of the pair of holes 62*a* facing the removal direction D22.

The pair of guide surfaces 62*b* are surfaces facing the roller unit 5 when the roller unit 5 is mounted in the mounting portion 6 in the mounting direction D21. The pair of guide surfaces 62*b* are inclined with respect to the crossing direction D2. The pair of guide surfaces 62*b* are inclined such that the space formed therebetween along the width direction D1 gradually decreases in the mounting direction D21 (see FIG. 8). In other words, the pair of guide surfaces 62*b* are inclined inward along the width direction D1 in the mounting direction D21.

The biasing mechanism 65 biases the pair of bearing support members 62 toward the support positions. In the present embodiment, the biasing mechanism 65 includes a first spring 65*a* and a second spring 65*b* (see FIGS. 6 to 8). The first spring 65*a* and the second spring 65*b* bias the pair of bearing support members 62 inward in the width direction D1. The first spring 65*a* and the second spring 65*b* are an example of a pair of biasing members.

The first spring 65*a* biases the specific support member 620, which is the one of the pair of bearing support members 62, toward its support position. The second spring 65*b* biases the other one of the pair of bearing support members 62 toward its support position.

The mounting portion 6 is further provided with a drive shaft 63, a drive gear 64, and a slide support portion 612 (see FIGS. 6 to 8). The base member 61 includes the slide support portion 612.

The drive shaft 63 engages with the first end of the rotation shaft 32*x* of the feed roller 32. The drive shaft 63 rotates upon receiving an external force and transmits the rotational force to the rotation shaft 32*x*.

In the example shown in FIG. 7, the drive shaft 63 is composed of a combination of a shaft member 631 and a coupling member 632. One end of the shaft member 631, or an engagement portion 63*a*, engages with the first end of the rotation shaft 32*x* of the feed roller 32. The coupling member 632 is assembled in the other end of the shaft member 631.

The engagement portion 63*a* of the drive shaft 63 is fitted in the hole 62*a* in the specific support member 620. The engagement portion 63*a* engages with the first end of the rotation shaft 32*x* of the feed roller 32 inside the hole 62*a* in the specific support member 620.

The first spring 65*a* biases the coupling member 632 inward in the width direction D1. The coupling member 632 is connected to the drive gear 64. The rotational force of the drive gear 64 is transmitted to the shaft member 631 through the coupling member 632.

The drive shaft 63 may be composed of one member including portions each corresponding to the shaft member 631 and the coupling member 632.

The slide support portion 612 supports the drive shaft 63 such that the drive shaft 63 can move in the width direction D1. The drive shaft 63 is supported to be movable in the width direction D1 integrally with the specific support member 620. That is, the drive shaft 63 is movable in the width direction D1 integrally with the specific support member 620

The first spring 65*a* biases the drive shaft 63 in the width direction D1 toward the mounting space 60. Thus, the first spring 65*a* biases the specific support member 620 toward the support position through the drive shaft 63.

The drive gear 64 is connected to the end of the drive shaft 63 on the outer side along the width direction D1. In the present embodiment, the coupling member 632 is the end of the drive shaft 63 on the outer side along the width direction D1. The drive gear 64 rotates by being driven by a motor and a gear mechanism (both not shown).

The drive shaft 63 rotates as the drive gear 64 rotates. Thus, the drive shaft 63 transmits the rotational force to the rotation shaft 32*x* of the feed roller 32.

[Mounting of Roller Unit 5]

The following describes actions of components of the roller unit 5 and the mounting portion 6 when the roller unit 5 is mounted in the mounting portion 6.

Figure 10:
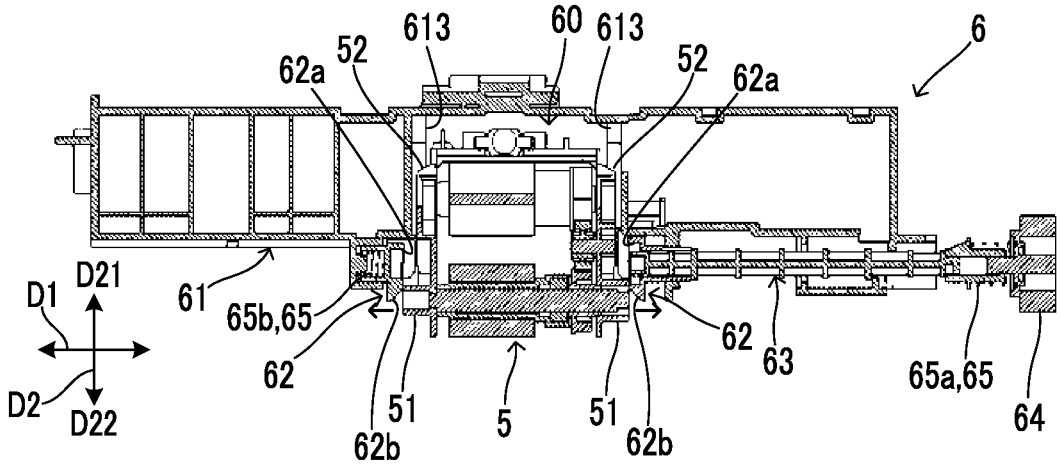
FIG. 10 shows a horizontal cross section of the roller unit and the mounting portion in the sheet conveying device according to the embodiment (before the mounting of the roller unit finishes).

As shown in FIGS. 9 and 10, the roller unit 5 is brought closer to the main body 1 in the crossing direction D2 to be inserted into the mounting space 60.

The base member 61 further includes a pair of guide support portions 613 (see FIGS. 6 and 8 to 10). The pair of guide support portions 613 face each other in the width direction D1 with the mounting space 60 therebetween and extend in the crossing direction D2.

The pair of guide support portions 613 support the pair of flange portions 52 of the roller unit 5. When the roller unit 5 is inserted into the mounting space 60 in the mounting direction D21, the pair of flange portions 52 slide on the pair of guide support portions 613. Thus, the pair of bearing portions 51 of the roller unit 5 are guided to the pair of guide surfaces 62*b* of the pair of bearing support members 62 (see FIG. 9).

In addition, when the roller unit 5 is inserted into the mounting space 60 in the mounting direction D21, the pair of bearing portions 51 abut on the pair of guide surfaces 62*b* and move the pair of bearing support members 62 from the support positions to the retraction positions (see FIG. 10).

Furthermore, the pair of guide surfaces 62*b* guide the pair of bearing portions 51 to the holes 62*a* in the pair of bearing support members 62. Thus, the roller unit 5 is guided to the mounting space 60. When the pair of bearing portions 51 pass through the pair of guide surfaces 62*b*, the pair of bearing support members 62 move inward in the width direction D1 by the action of the biasing mechanism 65 (see FIG. 11).

Figure 11:
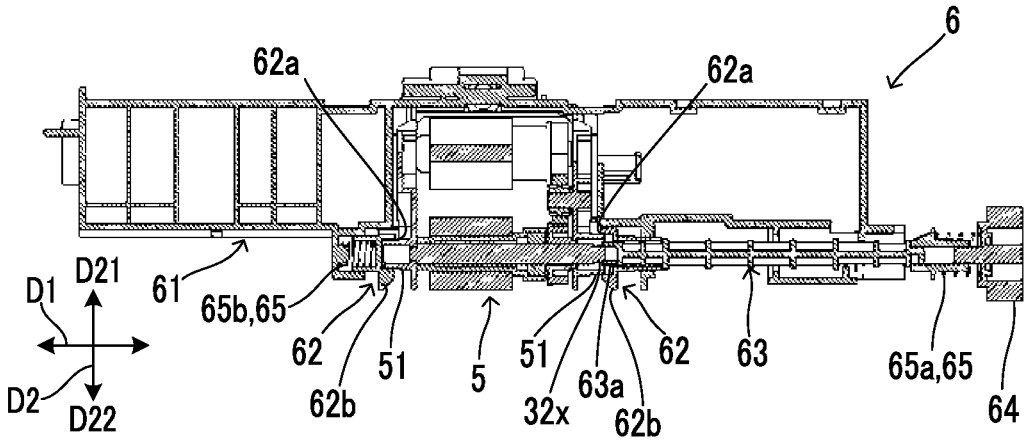
FIG. 11 shows a horizontal cross section of the roller unit and the mounting portion in the sheet conveying device according to the embodiment (when the roller unit is mounted).

The pair of bearing support members 62 move inward in the width direction D1 and thereby cause the pair of bearing portions 51 to be inserted into the holes 62*a* in the pair of bearing support members 62 (see FIG. 11). Thus, the roller unit 5 is swingably supported by the pair of bearing support members 62.

That is, after moving to the retraction positions, the pair of bearing support members 62 move back from the retraction positions to the support positions by the biasing force of the biasing mechanism 65 and support the pair of bearing portions 51. This completes the mounting of the roller unit 5 in the mounting portion 6.

As described above, the mounting of the roller unit 5 involves only moving the roller unit 5 in the mounting direction D21. In this case, the users can mount the roller unit 5 in the mounting portion 6 of the main body 1 with intuitive simple operation.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a housing; and a sheet feed portion including a mounting portion disposed in the housing and a rotating body unit mountable in the mounting portion and configured to feed a sheet placed on a sheet placement portion to a conveyance path, wherein the rotating body unit includes:

a rotating body with a rotation shaft and a frame body supporting the rotating body, the rotating body unit being mountable in the mounting portion in a mounting direction intersecting a width direction along the rotation shaft, the frame body includes:

a pair of sidewalls facing each other in the width direction; and a pair of bearing portions protruding outward from the pair of sidewalls in the width direction and supporting both ends of the rotation shaft such that the rotation shaft can rotate, the mounting portion includes:

a pair of opposing walls facing each other in the width direction;

a mounting space formed between the pair of opposing walls;

a pair of bearing support members supported by the pair of opposing walls to be movable in the width direction; and a pair of biasing members configured to bias the pair of bearing support members inward in the width direction, when located at support positions inside the pair of opposing walls, the pair of bearing support members can support the pair of bearing portions, and when located at retraction positions outside the support positions along the width direction, the pair of bearing support members face each other with a space into which the pair of bearing portions can be inserted therebetween, the pair of bearing support members include a pair of guide surfaces inclined inward along the width direction and facing the rotating body unit when the rotating body unit is mounted in the mounting portion in the mounting direction, and when the rotating body unit is inserted into the mounting space in the mounting direction, the pair of bearing portions abut on the pair of guide surfaces of the pair of bearing support members and move the pair of bearing support members from the support positions to the retraction positions, and then the pair of bearing support members move from the retraction positions to the support positions by a biasing force of the pair of biasing members to support the pair of bearing portions.

2. The sheet conveying device according to claim 1, wherein the sheet feed portion further includes a drive shaft that engages with one end of the rotation shaft of the rotating body and that transmits a rotational force to the rotation shaft, the drive shaft is supported to be movable in the width direction integrally with one of the pair of bearing support members, and one of the pair of biasing members biases the drive shaft inward in the width direction and thereby biases the one of the pair of bearing support members toward the support position through the drive shaft.

3. The sheet conveying device according to claim 1, wherein the frame body includes a pair of flange portions protruding from the pair of sidewalls in the width direction and extending in the mounting direction, the mounting portion includes a pair of guide support portions that support the pair of flange portions, and when the rotating body unit is inserted into the mounting space in the mounting direction, the pair of flange portions slide on the pair of guide support portions, and thereby the pair of bearing portions are guided to be in contact with the pair of guide surfaces.

4. An image forming apparatus comprising:

the sheet conveying device according to claim 1; and a printing device configured to form an image on a sheet conveyed by the sheet conveying device.

* * * * *